United States Patent [19]

Nelson

[11] 3,930,609

[45] Jan. 6, 1976

[54] CENTRIFUGE PREVENTING AIR ADMISSION DURING SLUDGE DISCHARGE

[75] Inventor: Kurt Nelson, Wappingers Falls, N.Y.

[73] Assignee: The De Laval Separator Company, Poughkeepsie, N.Y.

[22] Filed: Aug. 5, 1974

[21] Appl. No.: 494,961

[52] U.S. Cl. ..... 233/20 A

[51] Int. Cl.[2] ..... B04B 1/14

[58] Field of Search.... 233/20 R, 20 A, 19 R, 19 A, 233/21, 27, 28, 1 A, 46

[56] References Cited

UNITED STATES PATENTS

| | | | |
|---|---|---|---|
| 3,563,453 | 2/1971 | Kompert et al. | 233/20 R |

FOREIGN PATENTS OR APPLICATIONS

| | | | |
|---|---|---|---|
| 213,945 | 6/1967 | Sweden | 233/19 R |
| 675,648 | 7/1952 | United Kingdom | 233/20 R |

*Primary Examiner*—George H. Krizmanich
*Attorney, Agent, or Firm*—Cyrus S. Hapgood

[57] ABSTRACT

The centrifuge comprises a centrifugal bowl having means for alternately opening and closing its outer periphery to discharge separated sludge intermittently from the separating chamber, there being a stationary paring disk in a paring chamber of the bowl for discharging separated liquid from the bowl while its outer periphery is closed to maintain a normal liquid level in the bowl. The paring chamber has an air passage located radially inward toward the bowl axis from this normal liquid level and adapted to discharge air from the bowl to atmosphere while the liquid is at said normal level, the liquid level moving radially outward in response to opening of the bowl's outer periphery. A dam rotating with the bowl limits this outward movement of the liquid level in the paring chamber so as to maintain therein a minimum liquid level during the sludge discharge, and means in the paring chamber are operable at this minimum liquid level to prevent air from being sucked into the bowl through the air passage during the sludge discharge.

7 Claims, 1 Drawing Figure

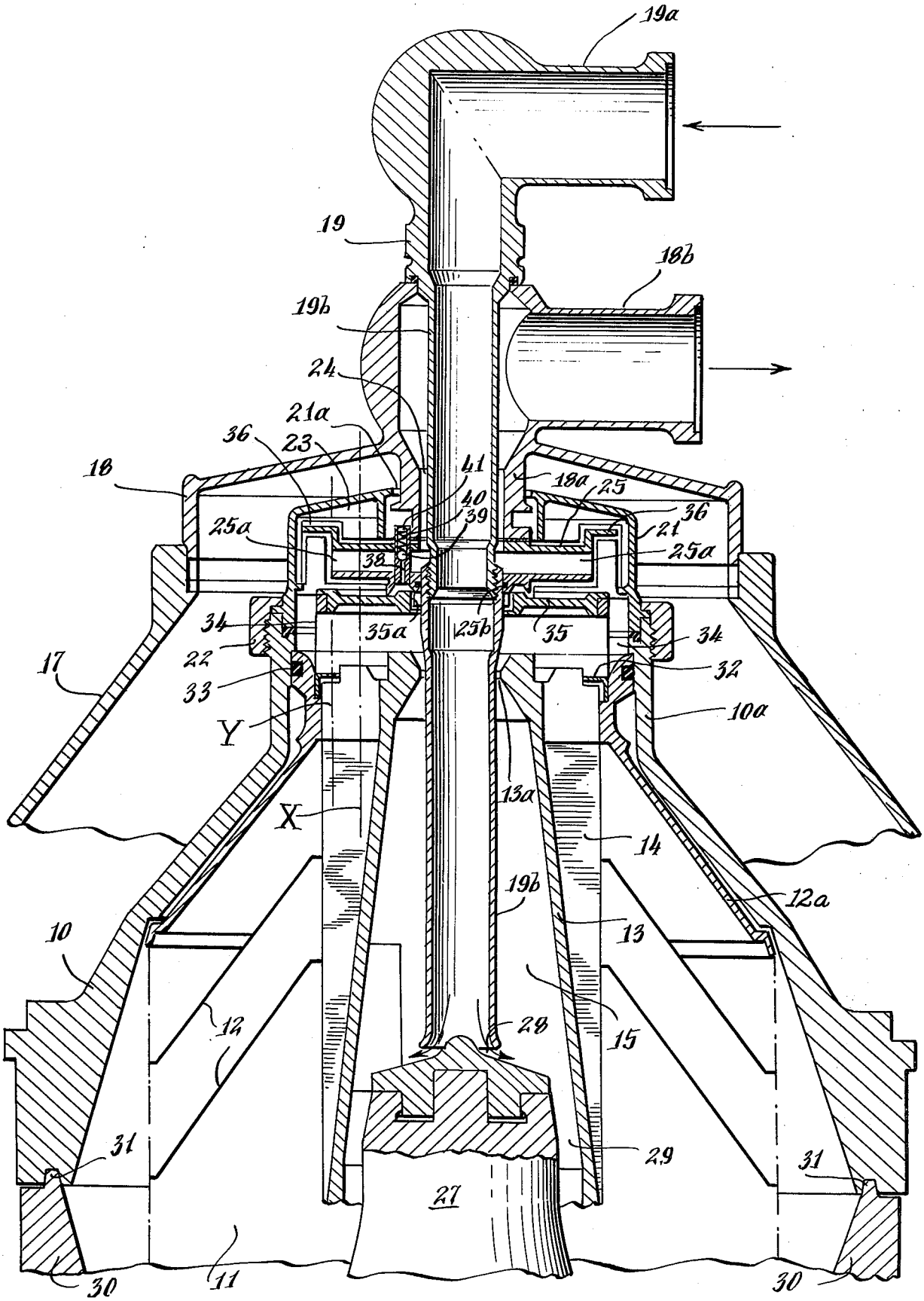
19a
19
18b
19b
24
21a
36
23
41
18
18a
25
40
39
36
21
25a
38
25a
34
35a
25b
35
34
22
32
17
33
10a
Y
13a
X
14
19b
12a
10
13
12
28
15
31
29
31
27
30
11
30

CENTRIFUGE PREVENTING AIR ADMISSION DURING SLUDGE DISCHARGE

THE DISCLOSURE

This invention relates to continuously operating sludge centrifuges of the type having means for alternately opening and closing the periphery of the centrifugal bowl to discharge separated sludge intermittently from the bowl's separating chamber, the bowl having a paring chamber for receiving liquid separated in the separating chamber and containing a stationary paring disk for discharging the separated liquid from the bowl while its periphery is closed to accumulate sludge separated in the separating chamber.

In centrifuges of this type as commonly made, the bowl's paring chamber has a passage for discharging air to atmosphere from the interior of the bowl during its normal operation, that is, while its periphery is closed to accumulate separated sludge during feeding of the liquid-solids mixture to the bowl's separating chamber. This air discharge passage is located between the rotation axis of the bowl and the liquid level maintained in the bowl during its normal operation, and the discharge passage serves to prevent the build-up of air pressure in the free central space of the bowl during its normal operation.

However, this air discharge passage in prior centrifuges has an adverse effect when the bowl's periphery is opened to discharge accumulated sludge. That is, this opening of the bowl's periphery causes the liquid level in the bowl to recede radially outward from the rotation axis, so that air is sucked into the bowl through the air passage as the sludge discharges through the bowl's periphery. As a result, air enters the separated liquid or effluent in the bowl during the sludge discharge, and this is usually undesirable.

The principal object of the present invention is to provide a sludge centrifuge of the type described which avoids this adverse effect.

According to the invention, a dam rotating with the bowl is located therein to limit outward movement of the liquid level in the paring chamber, thereby maintaining a minimum liquid level in this chamber during the sludge discharge; and the paring chamber is provided with means operable at this minimum liquid level to seal against the sucking of air into the bowl through the aforementioned air passage during the sludge discharge. Preferably such sealing means comprise a second dam forming an outward extension of the stationary paring disk which is dimensioned to remain substantially immersed in the liquid at said minimum level in the paring chamber, and a check valve for discharging air from the bowl through the air passage while the liquid is at the normal level in the paring chamber, the check valve operable to close against air admission from the air passage into the bowl in response to opening of the bowl's outer periphery.

For a better understanding of the invention, reference may be had to the accompanying drawing in which the single illustration is a vertical sectional view of a preferred form of a centrifuge embodying the invention.

The centrifuge as shown comprises a centrifugal bowl or rotor having a top 10 and a conventional main section or shell (not shown) to which the top 10 is secured in the usual manner. This main section of the bowl forms with the top 10 a separating chamber 11 containing a conventional set of conical disks 12. The latter are mounted in the usual manner on a tubular shaft 13 of the bowl, this shaft being coaxial with the rotation axis of the bowl and having radial wings 14. Within the tubular shaft 13 is a feed chamber 15 of the bowl.

A stationary cover 17 is mounted on the frame (not shown) of the centrifuge. The cover 17 supports a stationary middle section 18 which in turn supports a stationary upper section 19 forming an inlet **19*a* for the sludge-containing mixture to be centrifuged. The upper section 19 has a depending feed tube 19*b* through which the feed mixture passes from inlet 19*a* downward into the feed chamber 15** of the bowl.

A cap 21 is mounted on top of the neck **10*a* of bowl top 10, the cap being secured to the bowl neck by a nut 22. The cap 21 forms a paring chamber 23** of the bowl.

The stationary middle section 18 has a depending sleeve **18*a* extending with a clearance through a central opening in the top of cap 21. This sleeve surrounds the feed tube 19*b* in spaced relation so as to form an annular passage 24. A stationary annular paring disk 25 of conventional form is secured to sleeve 18a and is located in the bowl's paring chamber 23, where the disk is provided with the usual inlet openings 25*a*. The bottom of paring disk 25 has an annular seal 25*b* which surrounds and engages an intermediate portion of feed tube 19*b*.**

A central nave 27 projects upwardly from the bottom of the main bowl section (not shown) and receives the upper end of a vertical shaft (not shown) for driving the bowl about its central vertical axis. The top of nave 27 is spaced somewhat below the lower end of feed tube **19*b* and forms therewith a passage 28 leading into the feed chamber 15. From the latter, the feed mixture flows downward through inlet passages 29 between tubular shaft 13 and nave 27, these passages leading in the usual manner to the separating chamber 11.**

A conventional annular slide valve 30 is mounted for vertical movements in the main section of the bowl. The valve 30 is normally held in its uppermost position against an annular seal 31 in the lower end of the bowl top 10, thereby closing the usual sludge outlets in the peripheral portion of the bowl. When a substantial quantity of separated sludge has accumulated in the peripheral part of the bowl, the slide valve 30 is allowed to move downward and thereby cause discharge of sludge radially outward through the peripheral outlets of the bowl. This discharge of the sludge, sometimes referred to as a shoot, is usually effected during an interruption of the feed to the centrifuge inlet **19*a*, the feed being resumed when the slide valve 30 is returned to its uppermost position to terminate the sludge discharge. The up and down movements of slide valve 30** are effected hydraulically in any manner known in the art, for example, as disclosed in U.S. Pat. No. 3,637,134 granted Jan. 25, 1972.

The stationary middle section 18 has a horizontal duct **18*b* forming an outlet for the effluent separated in the separating chamber 11. During normal operation of the bowl, with slide valve 30 in its closing position as shown, the sludge separated from the feed mixture accumulates in the peripheral part of separating chamber 11 while the liquid effluent, which is the lighter component of the mixture, is displaced radially inward between the disks 12 and thence upwardly between the wings 14 of the tubular shaft. The effluent then overflows a horizontal ledge or dam formed by an annular member 32 secured to the top disk 12*a*** of the bowl.

The upper portion of top disk 12*a* is provided with an external annular seal 33 which seats against the inner surface of the bowl neck 10*a*.

After overflowing the dam 32, the effluent flows outwardly and upwardly via passages 34 to the paring chamber 23. The bottom of the paring chamber is formed by a horizontal disk 35 secured to the bowl top 10 and forming a clearance around the feed tube 19*b*. By means of paring disk 25, the effluent is pared in the usual manner from chamber 23 and is discharged upwardly through annular passage 24 to the outlet duct 18*b*.

Paring disk 25 is provided at its upper peripheral portion with a flange 36 located above the level of the disk inlets 25*a* and extending continuously around the bowl axis. Flange 36 projects radially outward so that its outer edge is at a substantially greater radial distance from the bowl axis than are the disk inlets 25*a*, whereby the flange constitutes a second dam which performs a sealing function to be described presently.

Extending vertically through the inner portion of paring disk 25 is a tube 38 containing a ball shaped valve member 39. The latter is urged downward against its seat in the tube by means of a coil spring 40 confined between member 39 and an annular member 41 in the upper end of tube 38. Thus, the parts 38–41 form a check valve which allows air to flow only in the upward direction through tube 38.

In the operation of the centrifuge, the bowl 10 is driven continuously about its vertical axis so that the feed mixture entering chamber 11 is separated centrifugally into sludge and effluent, as previously described. With slide valve 30 in its upper or closed position, and with the effluent discharging through paring disk 25 and outlet 18*b* during feed of the mixture through inlet 19*a*, the rotating body of effluent in the bowl forms an inner annular wall concentrically surrounding the rotor axis at a relatively small radial distance therefrom, as shown by the broken vertical line X. This line X represents the normal level maintained by the inner wall of the effluent during the separation and while separated sludge is accumulating in the peripheral part of the bowl. It will be observed that the normal level X is sufficiently near the rotor axis so that paring disk 25 extends for a substantial depth into the annular body of effluent in paring chamber 23, whereby paring disk 25 is operable to discharge separated effluent through outlet 18*b*.

During this normal operation of the centrifuge, check valve 38–41 permits air to escape from the free space below the check valve to atmosphere by way of an annular air passage 21*a* between the rotating cap 21 and the stationary sleeve 18*a*. Thus, air from feed chamber 15 can pass upwardly through clearance spaces 13*a* and 35*a* into paring chamber 23 for discharge through check valve 38–41, thereby preventing a build-up of air pressure in the bowl's free space which is surrounded by the annular body of liquid at the normal level X. Of course, this discharging air may be joined by any air entering the free space from the separated effluent.

When slide valve 30 is lowered to discharge accumulated sludge through the bowl's periphery (i.e., to effect a bowl shoot), the liquid level in the bowl moves radially outward from the normal level X. However, because of dam 32, the liquid level in paring chamber 23 cannot move outward beyond a minimum level represented by broken line Y. At this minimum level Y, the dam 36 on the paring disk remains immersed in the liquid body of effluent in paring chamber 23, thus forming a seal to prevent air from entering the effluent below dam 36. Although the minimum level Y does not provide a sufficient pressure head for paring disk 25 to continue its discharge of effluent, it is sufficient to cover the disk opening 25*a* and prevent entrance of air into the paring chamber from the paring disk. At the same time, check valve 38–41 prevents air from being sucked into the bowl through passage 21*a* during the sludge discharge.

When slide valve 30 is returned to its raised position to again close the bowl periphery, upon completion of the sludge discharge, the liquid level in the bowl will move inwardly (increase) due to resumption of the feed through inlet 19*a*, if the feed was interrupted during the sludge discharge, or due to continuance of this feed if it was not interrupted. Thus, the liquid in paring chamber 23 will return to its normal level X and the discharge of liquid through paring disk 25 and outlet 18*b* will resume.

As will be apparent from the foregoing, the rotating dam 32 maintains a minimum liquid level Y in paring chamber 23 during the sludge discharge, regardless of the liquid level in separating chamber 11. The stationary dam 36 and check valve 38–41 constitute means in the paring chamber operable at the minimum liquid level Y to prevent air from being sucked into the bowl through air passage 21*a* during the sludge discharge, the check valve being operable to discharge air through passage 21*a* while the liquid is at its normal level X in the paring chamber.

I claim:

1. A sludge centrifuge comprising a centrifugal bowl rotatable about an axis and forming a separating chamber having an inlet for a mixture of liquid and solids, the bowl also forming a paring chamber communicating with the separating chamber for receiving therefrom a liquid separated as a relatively light component from said mixture, the separating chamber having an outer sludge space for receiving solids separated from said mixture as a relatively heavy sludge component, means for alternately opening and closing the outer periphery of the bowl to discharge sludge intermittently from said sludge space, a stationary paring disk in the paring chamber for discharging separated liquid from the bowl while its said outer periphery is closed to maintain a normal liquid level in the bowl, said liquid level moving radially outward from the bowl axis in response to opening of the bowl's outer periphery, the paring chamber having an air passage at its radially inner portion for discharging air from the bowl to atmosphere while the liquid is at said normal level, a dam rotating with the bowl and located therein to limit said outward movement of the liquid level in the paring chamber, thereby maintaining a minimum liquid level in the paring chamber during said sludge discharge, and means in the paring chamber operable at said minimum liquid level to prevent air from being sucked into the bowl through said air passage during said sludge discharge.

2. The centrifuge of claim 1, in which said means in the paring chamber include a second dam forming an outward extension of the stationary paring disk and dimensioned to remain substantially immersed in the liquid at said minimum level.

3. The centrifuge of claim 1, in which said means in the paring chamber include a check valve for discharging air from the bowl through said air passage while the liquid is at said normal level in the paring chamber, the check valve being operable to close against air admission from said air passage into the bowl in response to said opening of the bowl's outer periphery.

4. The centrifuge of claim 1, in which said means in the paring chamber include a second dam forming an outward extension of the stationary paring disk and dimensioned to remain substantially immersed in the liquid at said minimum level, whereby the second dam seals against entrance of air from said passage into the separated liquid in the bowl during said sludge discharge, said means in the paring chamber also including a check valve for discharging air from the bowl through said air passage while the liquid is at said normal level in the paring chamber, the check valve being operable to close against air admission from said air passage into the bowl in repsonse to said opening of the bowl's outer periphery.

5. The centrifuge of claim 4, in which said check valve extends through the paring disk from an inner portion of the paring chamber at one side of the disk to region of said air passage at the outer side of the disk.

6. The centrifuge of claim 1, in which said rotating dam is an annular member having a radially inner edge over which liquid flows in passing from the separating chamber to the paring chamber.

7. The centrifuge of claim 2, in which the paring disc has inlet openings for receiving separated liquid for discharge from the bowl, said second dam being situated above said paring disc openings.

* * * * *